US009778607B2

(12) United States Patent
Kawaguchi et al.

(10) Patent No.: US 9,778,607 B2
(45) Date of Patent: Oct. 3, 2017

(54) FIXING DEVICE HAVING FIXING BELT AND IMAGE FORMING APPARATUS INCLUDING THE SAME

(71) Applicant: KYOCERA Document Solutions Inc., Osaka (JP)

(72) Inventors: Kotatsu Kawaguchi, Osaka (JP); Yoshihiro Yamagishi, Osaka (JP); Takashi Eiki, Osaka (JP); Takefumi Yotsutsuji, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/208,054

(22) Filed: Jul. 12, 2016

(65) Prior Publication Data

US 2017/0017183 A1 Jan. 19, 2017

(30) Foreign Application Priority Data

Jul. 15, 2015 (JP) ..... 2015-141397

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
None
See application file for complete search history.

(56) References Cited

U.S. PATENT DOCUMENTS

2011/0206409 A1* 8/2011 Kondo ..... G03G 15/2017 399/92
2013/0078017 A1* 3/2013 Imaizumi ..... G03G 15/2053 399/329
2013/0209147 A1 8/2013 Ogawa et al.
2015/0168897 A1 6/2015 Ogawa et al.
2016/0320729 A1* 11/2016 Park ..... G03G 15/2053

* cited by examiner

*Primary Examiner* — Thomas Giampaolo, II
(74) *Attorney, Agent, or Firm* — Wenderoth, Lind & Ponack, L.L.P.

(57) ABSTRACT

Provided is a fixing device including a pair of end deformation restraint members. A restraint body 35 of the end deformation restraint member has an insertion part 38 which is inserted into both end portions of a fixing belt, and restrains deformation of belt end portions by holding both end portions of the fixing belt, which slides on an outer peripheral surface of the insertion part 38, from inside in the insertion part 38. The insertion part 38 is continued in a belt rotation direction with no gap.

6 Claims, 12 Drawing Sheets

Fig.7

| | Curvature radius R | Number of durable papers |
|---|---|---|
| Comparison example | 1mm | Breakage in passing 62,000 papers |
| Example 1 | 2mm | No breakage in passing 200,000 papers |
| Example 2 | 3mm | No breakage in passing 200,000 papers |
| Example 3 | 4mm | No breakage in passing 200,000 papers |
| Example 4 | 5mm | No breakage in passing 200,000 papers |

FIXING DEVICE HAVING FIXING BELT AND IMAGE FORMING APPARATUS INCLUDING THE SAME

CROSS-REFERENCE TO RELATED APPLICATION

This application is based upon and claims the benefit of priority from Japanese Patent Application No. 2015-141397 filed on Jul. 15, 2015, the entire contents of which are incorporated herein by reference.

BACKGROUND

The technology of the present disclosure relates to a fixing device having a fixing belt and an image forming apparatus including the same.

Conventionally, as a fixing device mounted in an electrophotographic image forming apparatus, there has been known a fixing device in which a pressure roller is allowed to be brought into press contact with an endless fixing belt having an approximately cylindrical shape and flexibility, the fixing belt is rotated by rotational driving of the pressure roller, and a paper is allowed to pass through between the fixing belt and the pressure roller, so that a toner image is fixed to the paper.

In such a conventional example, for example, an end deformation restraint member 101 as illustrated in FIG. 9 and FIG. 10 is used. FIG. 9 is a perspective view when the end deformation restraint member 101 and a member arranged in the fixing belt (not illustrated) are viewed from a bottom surface side. FIG. 10 is an enlarged front view of the end deformation restraint member 101. The end deformation restraint member 101 supported to a side plate (not illustrated) of a housing has been inserted into both end portions of the fixing belt. The end deformation restraint member 101 includes a base part 102 and an insertion part 103 projected on an inside surface of the base part 102. The insertion part 103 is inserted into both end portions of the fixing belt so as to slidably contact with an inner peripheral surface of the fixing belt, thereby holding both end portions of the fixing belt from the inside and restraining deformation of the belt end portions. An outer peripheral surface of the insertion part 103 serves as a guide surface that holds the inner peripheral surface of the fixing belt from the inside.

In FIG. 9, a reference numeral 104 indicates a heater and a reference numeral 105 indicates a support member. The heater 104 and the support member 105 pass through a through hole 101*a* of the end deformation restraint member 101. The support member 105 supports a reflecting plate (not illustrated), which has been arranged between the heater 104 and the support member 105, from below.

A reference numeral 106 indicates a cover member. The cover member 106 blocks radiant heat directed from the heater 104 to a non-paper passing area of the fixing belt.

A reference numeral 107 indicates a pressing member. The pressing member 107 is supported by the support member 105, so that warpage of the pressing member 107 is restrained. A bottom surface of the pressing member 107 presses the fixing belt toward the pressure roller (not illustrated), thereby forming a fixing nip between the fixing belt and the pressure roller.

The end portions of the support member 105 and the pressing member 107 are inserted into the insertion part 103 of the end deformation restraint member 101 so as to be held.

SUMMARY

An fixing device according to one aspect of the present disclosure includes a heating unit, a flexible fixing belt, a pressing member, and a pressure roller. The flexible fixing belt is an approximately cylindrical belt and is heated by the heating unit. The pressing member presses an inner peripheral surface of the fixing belt. The pressure roller is brought into press contact with the pressing member while interposing the fixing belt therebetween and is rotationally driven in the press-contact state, thereby rotating the fixing belt. The fixing device allows a paper to pass through between the fixing belt and the pressure roller to fix a toner image to the paper.

The fixing device further includes a pair of end deformation restraint members. The pair of end deformation restraint members have insertion parts which are inserted into both end portions of the fixing belt. The pair of end deformation restraint members restrain the deformation of belt end portions by holding both end portions of the fixing belt, which slides on outer peripheral surfaces of the insertion parts, from inside in the insertion parts. The each insertion part is continued in a belt rotation direction with no gap.

BRIEF DESCRIPTION OF THE DRAWINGS

FIG. 7 illustrates experimental data indicating a relation between a curvature radius of a paper passing entrance side and a paper passing discharge side of a restraint body and belt breakage.

DETAILED DESCRIPTION

Hereinafter, one example of an embodiment will be described in detail on the basis of the drawings. It is noted that the technology of the present disclosure is not limited to the following embodiment.

<<Embodiment>>

Figure 1:
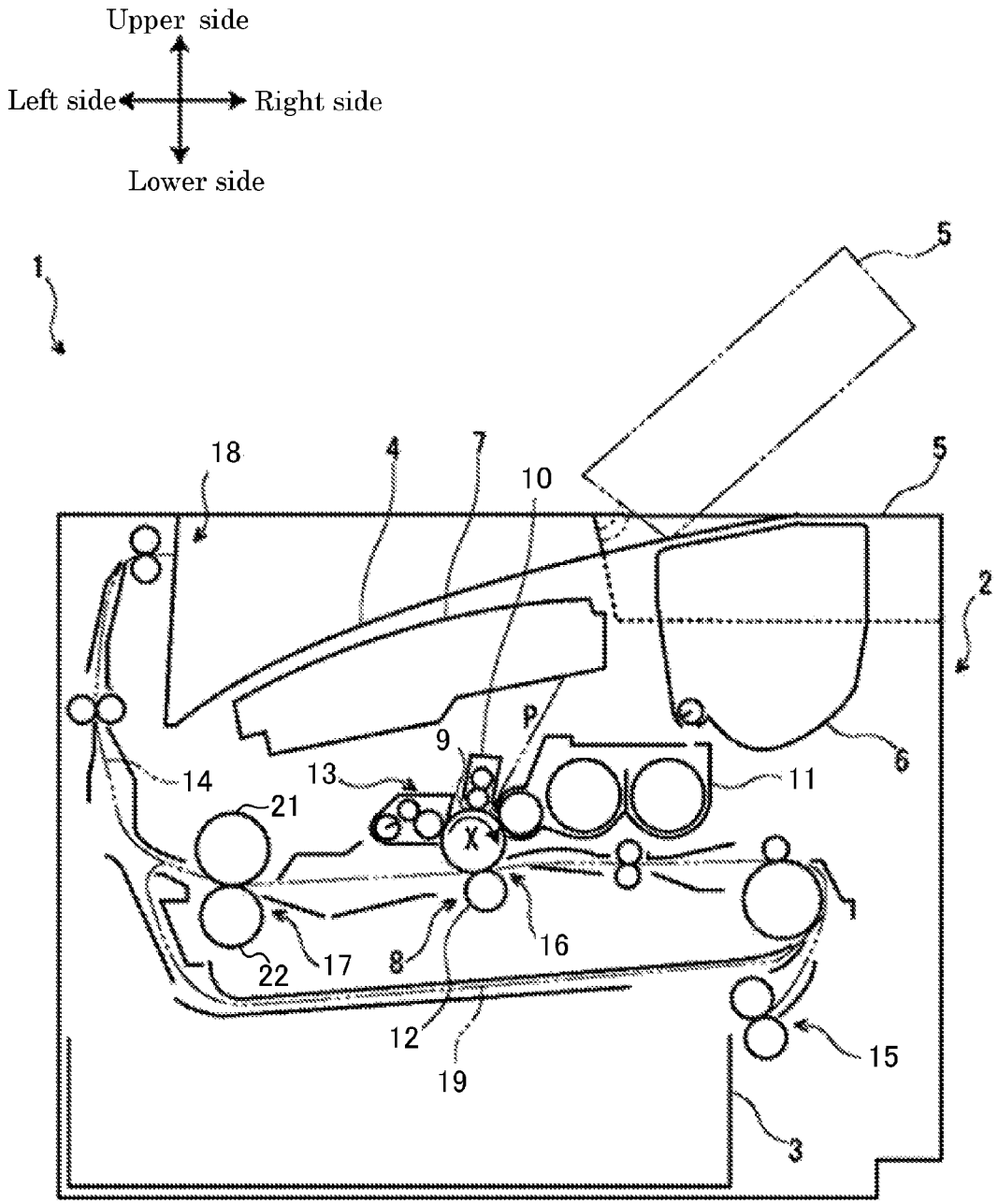
FIG. 1 is a schematic diagram illustrating an internal structure of a printer (an image forming apparatus).
Figure 2:
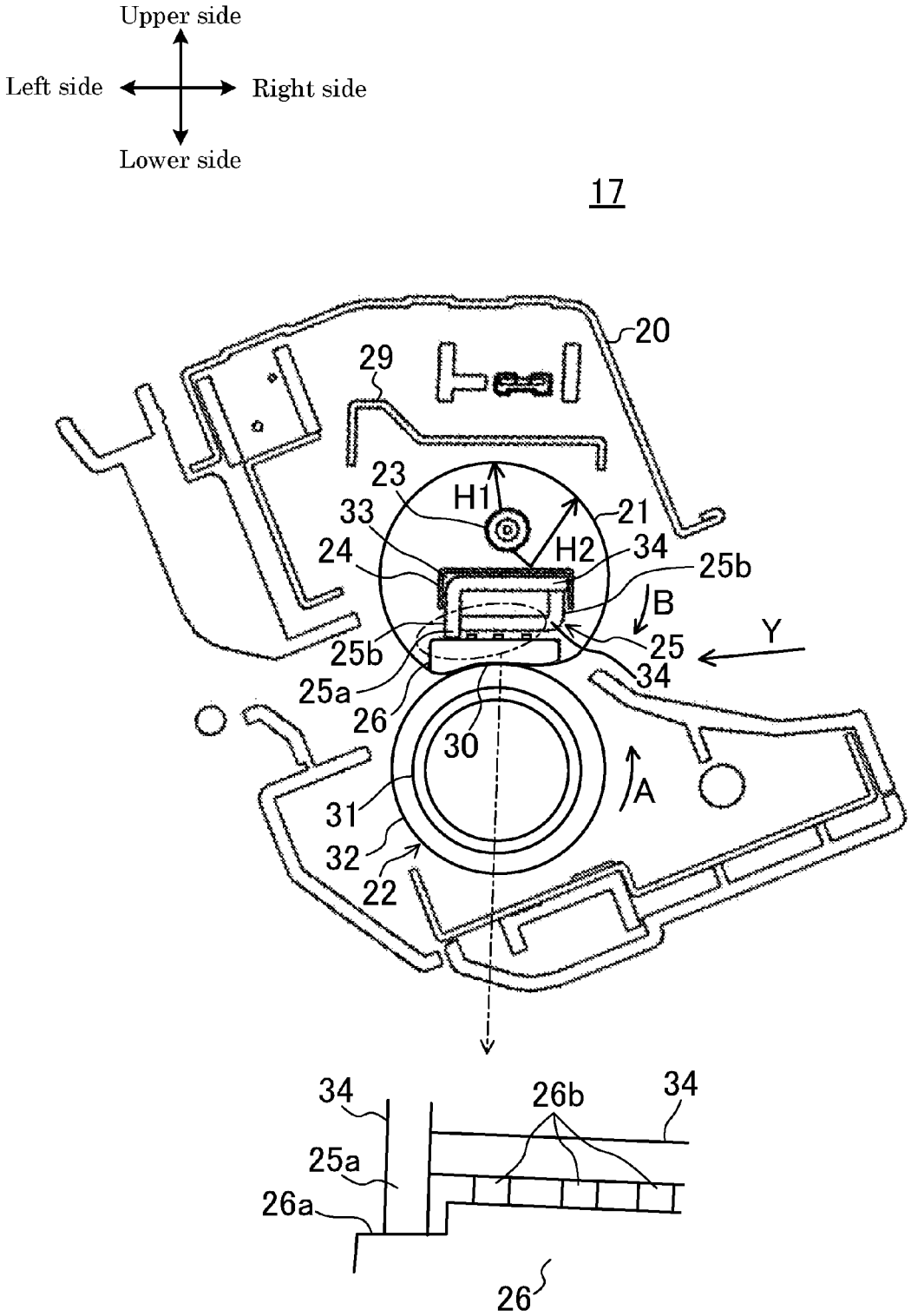
FIG. 2 is a sectional view of a fixing device.
Figure 3:
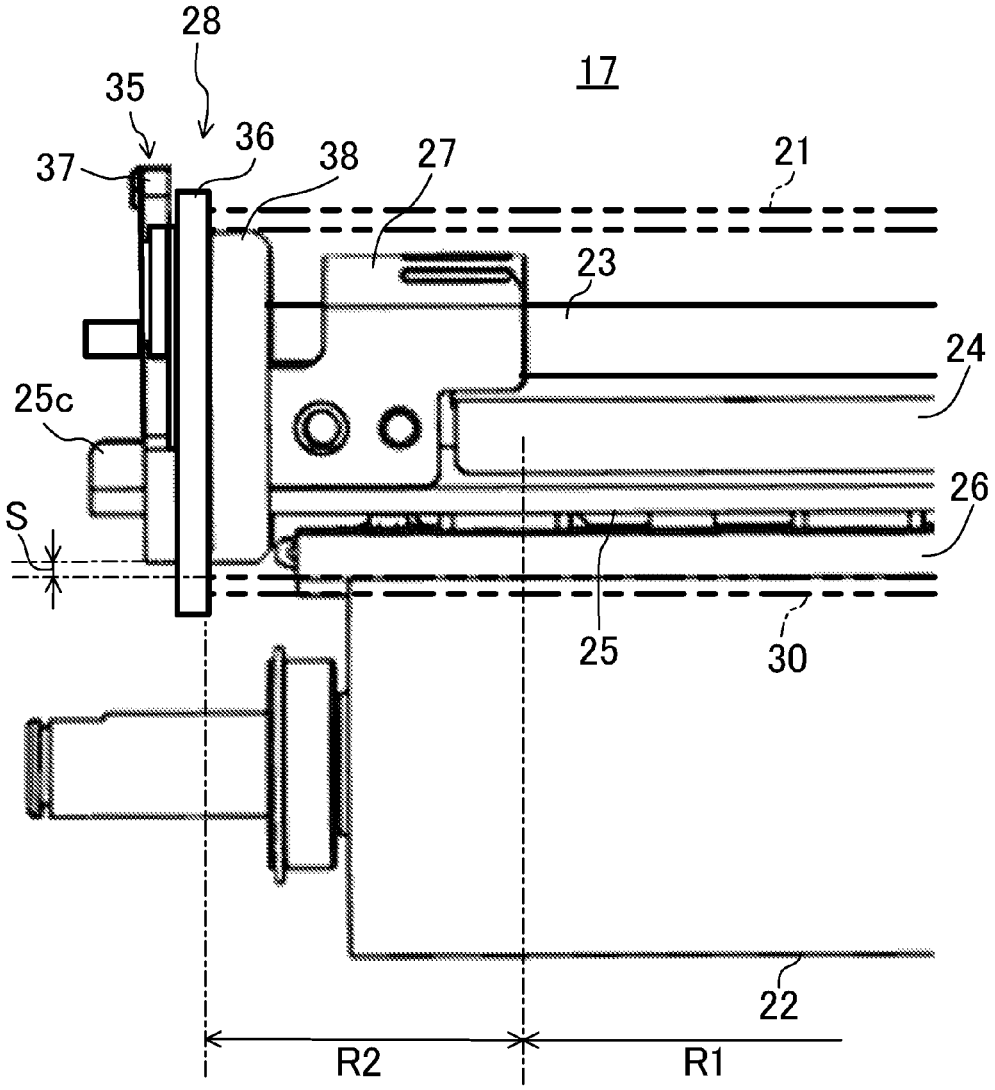
FIG. 3 is a front view illustrating one end side of a fixing device.

FIG. 1 is a schematic diagram illustrating an internal structure of a printer 1 (an image forming apparatus). In FIG. 1, a front side of a paper surface is defined as a "front side"

of the printer 1 and a back side of the paper surface is defined as a "rear side" of the printer 1. Furthermore, a left side of the paper surface is defined as a "left side" of the printer 1 and a right side of the paper surface is defined as a "right side" of the printer 1. Moreover, an upper side of the paper surface is defined as an "upper side" of the printer 1 and a lower side of the paper surface is defined as a "lower side" of the printer 1. These are common in FIG. 2. FIG. 3 is a view when FIG. 1 and FIG. 2 are viewed from the right side of the paper surface.

The printer 1 includes a box-like printer body 2. At a lower portion of the printer body 2, a paper feeding cassette is accommodated to store papers. The printer body 2 is provided on an upper surface thereof with a paper discharge tray 4 and an upper cover 5 vertically openable and closable. Below the upper cover 5, a toner container 6 is accommodated.

At an upper portion of the printer body 2, an exposure device 7 configured with a laser scanning unit (LSU) is arranged below the paper discharge tray 4. Below the exposure device 7, an image forming unit 8 is provided. The image forming unit 8 is rotatably provided with a photosensitive drum 9 serving as an image carrying member. Around the photosensitive drum 9, a charging device 10, a developing device 11, a transfer roller 12, and a cleansing device 13 are arranged along a rotation direction (see an arrow X of FIG. 1) of the photosensitive drum 9.

The printer body 2 is provided therein with a conveyance path 14 of paper. The conveyance path 14 is provided at an upstream end thereof with a paper feeding unit 15. The conveyance path 14 is provided at a midstream thereof with a transfer unit 16 configured by the photosensitive drum 9 and the transfer roller 12. The conveyance path 14 is provided at a downstream thereof with a fixing device 17. The conveyance path 14 is provided at a downstream thereof with a paper discharge unit 18. Below the conveyance path 14, an inversion path 19 for duplex printing is formed.

In the printer 1 configured as above, when the printer 1 is powered on, various parameters are initialized and initial setting such as temperature setting of the fixing device 17 is performed. Then, when image data is inputted from a computer and the like connected to the printer 1 and a print start instruction is issued, an image forming operation is performed as follows.

Firstly, the surface of the photosensitive drum 9 is charged by the charging device 10. Thereafter, exposure corresponding to the image data is performed for the photosensitive drum 9 by laser light (see a two dot chain line of FIG. 1) irradiated from the exposure device 7, so that an electrostatic latent image is formed on the surface of the photosensitive drum 9. Next, the electrostatic latent image is developed as a toner image by the developing device 11.

On the other hand, a paper taken out from the paper feeding cassette 3 by the paper feeding unit 15 is conveyed to the transfer unit 16 in accordance with the timing of the aforementioned image forming operation, and the toner image on the photosensitive drum 9 is transferred to the paper by the transfer unit 16. Toner remaining on the photosensitive drum 9 is collected by the cleansing device 13. The paper with the transferred toner image is conveyed to a downstream side of the conveyance path 14 and enters into the fixing device 17, so that the toner image is fixed to the paper in the fixing device 17. The paper with the fixed toner image is discharged to the paper discharge tray 4 from the paper discharge unit 18.

FIG. 2 is a sectional view of the fixing device 17 and an arrow Y of FIG. 2 indicates a paper conveyance direction. FIG. 3 is a front view illustrating one end side of the fixing device 17.

The fixing device 17 includes a fixing belt 21 in a housing 20 and a pressure roller 22 arranged below the fixing belt 21.

Inside the fixing belt 21, a heater (a heating part) 23 is arranged. Below the heater 23, a reflecting plate 24 is arranged. Below the reflecting plate 24, a support member 25 is arranged. Below the support member 25, a pressing member 26 is arranged. At both front and rear end portions of the support member 25, a cover member 27 is fixed. At both front and rear end portions of the fixing belt 21, an end deformation restraint member 28 is inserted. Above the fixing belt 21, a non-contact type thermal cut-off 29 is arranged to prevent excessive temperature rise of the fixing belt 21. In addition, in FIG. 3, the inside of the fixing belt 21 is seen through.

The fixing belt 21 is an approximately cylindrical and flexible belt which is long in a front and rear direction, and although not illustrated in the drawing, for example, an elastic layer is stacked at an outer periphery of an approximately cylindrical core material and a release layer is coated on an outer periphery of the elastic layer. When taking one example thereof, the core material, for example, is made of a metal such as SUS (a stainless steel) or a nickel having a diameter of 25. 4 mm and a thickness of 1 mm, or is made of resin such as PI (polyimide). The elastic layer, for example, is made of silicon rubber having a thickness of 270 μm. The release layer, for example, is made of a PFA (fluorine-based resin) tube having a thickness of 20 μm. An inner peripheral surface of the core material has been subjected to fluorine-based coating in order to improve slidability and thermal absorptivity of the fixing belt 21.

The fixing belt 21 includes a paper passing area R1 and a non-paper passing area R2 provided at both front and rear sides (outside in the front and rear direction of the paper passing area R1) of the paper passing area R1. The paper passing area R1 is an area through which a paper with a maximum size passes. The non-paper passing area R2 is an area through which the paper with the maximum size does not pass.

The pressure roller 22 is formed in an approximately cylindrical shape which is long in the front and rear direction and is connected to a driving source (not illustrated) such as a motor so as to rotate. The pressure roller 22 is brought into press contact with the fixing belt 21, so that a fixing nip 30 is formed between the fixing belt 21 and the pressure roller 22. In the pressure roller 22, for example, an elastic layer 32 is stacked on an outer periphery of an approximately cylindrical core material 31 and a release layer (not illustrated) is coated on an outer periphery of the elastic layer 32. When taking one example thereof, the core material 31, for example, is made of a metal such as an iron having a diameter of 25 mm and a thickness of 1 mm. The elastic layer 32, for example, is made of silicon rubber having a thickness of 5.5 mm. The release layer, for example, is made of a PFA tube having a thickness of 50 μm.

The heater 23, for example, is a halogen heater, and is arranged at an upper portion of an internal space of the fixing belt 21, that is, at a position eccentric to an upper side (a side separated from the pressure roller 22) with respect to a rotation center of the fixing belt 21, thereby heating the fixing belt 21.

The reflecting plate 24, for example, is made of a metal such as brilliant aluminum, is formed in a shape which is long in the front and rear direction, and is arranged between the heater 23 and the support member 25.

The support member 25 is formed in a shape which is long in the front and rear direction, and supports the reflecting plate 24 from below via a spacer 33 so as not to directly contact with the reflecting plate 24. The support member 25, for example, is formed by combining a pair of L shaped metal plates 34 including SECC (a galvanized steel plate) with each other in a quadrangular cylindrical shape. A left lower corner portion (a left lower end portion of the upper metal plate 34) of the support member 25 protrudes downward from the lower metal plate 34 and constitutes an engaging protrusion 25*a*. Both sidewalls 25*b* of the support member 25 extend along a vertical direction and are provided in parallel to each other. In this way, the support member 25 has an approximately rectangular contour shape. The support member 25 protrudes outward in the front and rear direction from the end deformation restraint member 28 and constitutes a protruding part 25*c* (see FIG. 3).

The pressing member 26, for example, is made of heat-resistant resin such as LCP (liquid crystal polymer) and is formed in a flat plate shape which is long in the front and rear direction. At left end portion of an upper surface of the pressing member 26, an engaging step lowering part 26*a* is formed. The engaging step lowering part 26*a* is engaged with the engaging protrusion 25*a* of the support member 25. From an upper surface of the pressing member 26, a plurality of bosses 26*b* are projected. An upper end portion of each boss 26*b* abuts a lower surface of the support member 25. By the configuration as above, the pressing member 26 is supported by the support member 25, so that the warpage of the pressing member 26 is restrained.

The left portion (a portion of a downstream side of a paper conveyance direction Y) of a lower surface of the pressing member 26 is inclined while being curved to a lower side (the pressure roller 22 side) from a right side (an upstream side of the paper conveyance direction Y) to a left side (the downstream side of the paper conveyance direction Y). The lower surface of the pressing member 26 presses an inner peripheral surface of the fixing belt 21 downward (the pressure roller 22 side).

The pressure roller 22 is brought into press contact with the pressing member 26 while interposing the fixing belt 21 therebetween and is rotationally driven in the press-contact state, thereby rotating the fixing belt 21. Furthermore, a paper is allowed to pass through between the fixing belt 21 and the pressure roller 22, so that a toner image is fixed to the paper.

The cover member 27 is formed in an approximately U shape in the front view. The cover member 27 has a position in the front and rear direction, which corresponding to the non-paper passing area R2 of the fixing belt 21, and has a function of blocking radiant heat directed from the heater 23 to the non-paper passing area R2 of the fixing belt 21.

The end deformation restraint member 28 is arranged as a pair outward in the front and rear direction from the cover member 27, and is supported to a side plate (not illustrated) of the housing 20 serving as a device fixing side. The end deformation restraint member 28 includes a restraint body 35 and a ring 36 mounted at the restraint body 35.

Figure 4:
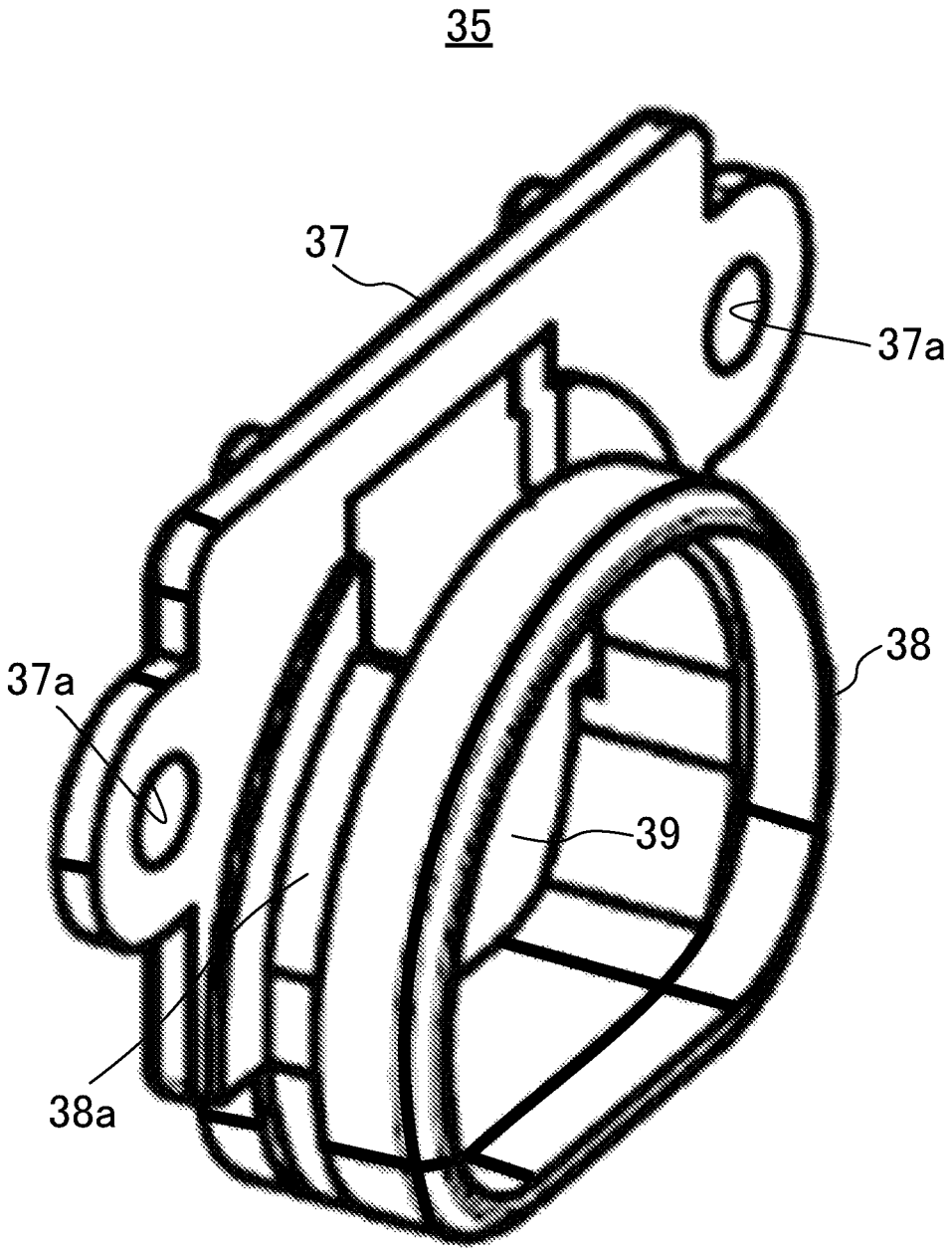
FIG. 4 is an enlarged perspective view of an end deformation restraint member (a restraint body).
Figure 5:
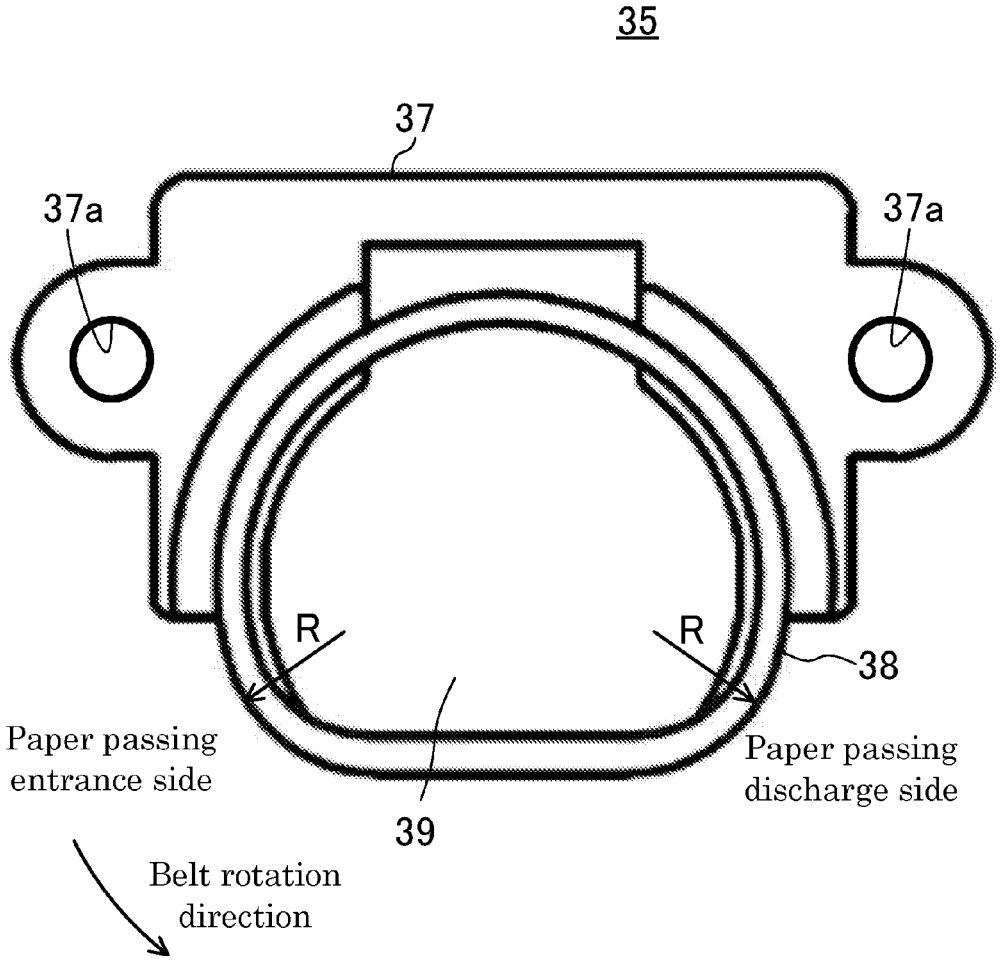
FIG. 5 is an enlarged front view of an end deformation restraint member (a restraint body).
Figure 6:
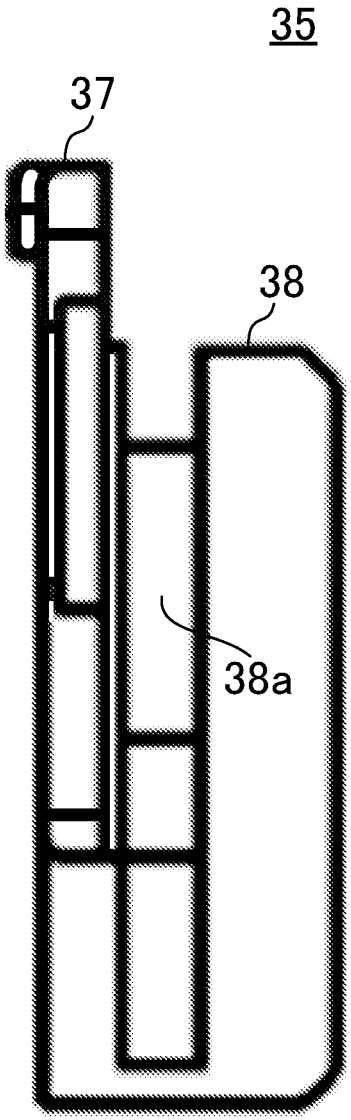
FIG. 6 is an enlarged side view of an end deformation restraint member (a restraint body).

As shown in an enlarged manner in FIG. 4 to FIG. 6, the restraint body 35 includes a base part 37 and an insertion part 38 projected from an inner surface in the front and rear direction of the base part 37 and integrally formed with the base part 37.

The restraint body 35 is formed with a through hole 39 passing through the base part 37 and the insertion part 38 in the front and rear direction, and the heater 23 and the support member 25 pass through the through hole 39 (see FIG. 3). The base part 37 is formed at both right and left ends of an upper part thereof with mounting holes 37*a* for fixing the restraint body 35 to the side plate of the housing 20.

The insertion part 38 is inserted into both front and rear end portions of the fixing belt 21 so as to contact with the inner peripheral surfaces of both front and rear end portions of the fixing belt 21, and holds both end portions of the fixing belt 21, which slides on an outer peripheral surface of the insertion part 38, from the inside, thereby restraining the deformation of the belt end portions. The outer peripheral surface of the insertion part 38 serves as a guide surface that holds the inner peripheral surface of the fixing belt 21 from the inside.

The insertion part 38 is continued in the belt rotation direction with no gap and forms an approximately ring shape.

Figure 9:
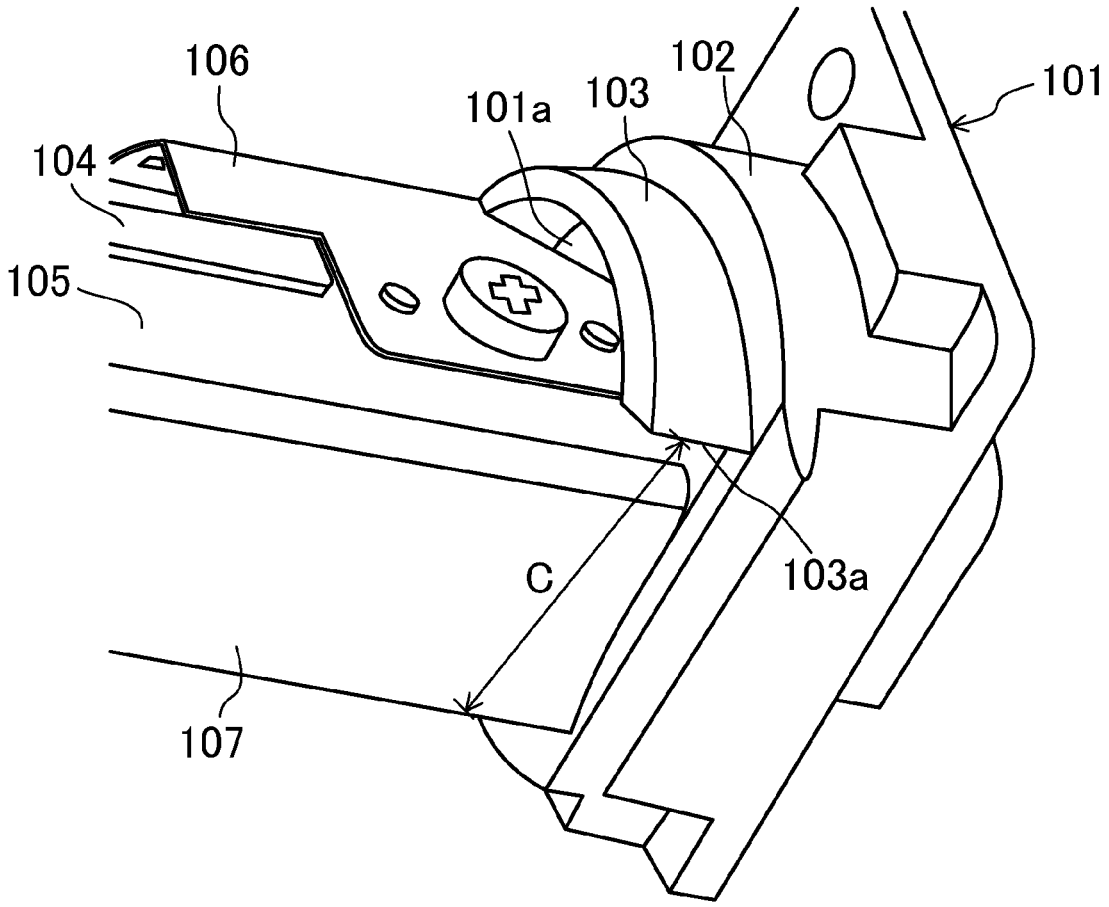
Fig.9 Prior Art
FIG. 9 is a perspective view when an end deformation restraint member of a conventional example and a member arranged in a fixing belt are viewed from a bottom surface side.
Figure 10:
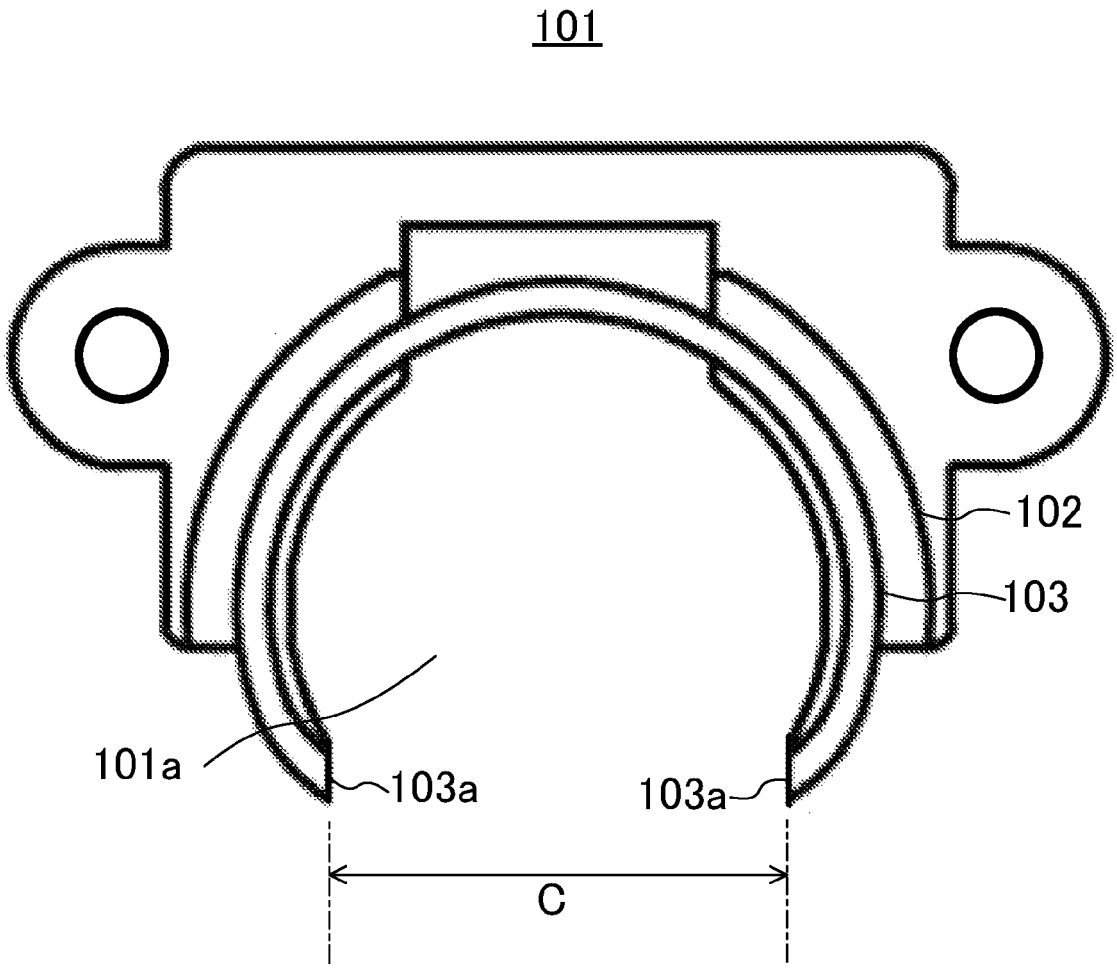
Fig.10 Prior Art
FIG. 10 is an enlarged front view of an end deformation restraint member of a conventional example.

In the conventional example, as illustrated in FIG. 9 and FIG. 10, since the insertion part 103 of the end deformation restraint member 101 is formed with a notch portion C, when the fixing belt rotates and the inner peripheral surface of the fixing belt slides on the outer peripheral surface of the insertion part 103, the fixing belt is deformed at opened end portions 103*a* corresponding to both ends of the notch portion C and stress is concentrated, so that the fixing belt repeatedly receives the stress by its rotation and reaches fatigue breakdown.

However, in the present embodiment, as illustrated in FIG. 4 and FIG. 5, since the insertion part 38 of the end deformation restraint member 28 does not have the notch portion C as with the conventional example and is continued in the belt rotation direction with no gap, the inner peripheral surface of the fixing belt 21 smoothly slides on the outer peripheral surface of the insertion part 38. Accordingly, differently from the conventional example, there is no problem that the fixing belt is deformed at the opened end portions corresponding to both ends of the notch portion C and stress is concentrated. Consequently, it is possible to prevent the fatigue breakdown of the fixing belt 21 due to the slide of the inner peripheral surface of the fixing belt 21 with respect to the outer peripheral surface of the insertion part 38 of the end deformation restraint member 28.

Furthermore, a curvature radius R of a paper passing entrance side (a left corner part of FIG. 5) and a paper passing discharge side (a right corner part of FIG. 5) on the outer peripheral surface of the insertion part 38 of the end deformation restraint member 28 (the restraint body 35) is equal to or more than 2 mm.

In this way, smooth sliding of the fixing belt 21 is ensured, so that it is possible to increase the fatigue breakdown prevention effect of the fixing belt 21.

FIG. 7 illustrates experimental data indicating its basis and illustrates a relation between the curvature radius R of the paper passing entrance side and the paper passing discharge side of the restraint body 35 and belt breakage. That is, in a comparison example in which the curvature radius R is 1 mm, the fixing belt 21 has been broken when the number of passed papers is 62,000, but in all of an example 1 in which the curvature radius R is 2 mm, an example 2 in which the curvature radius R is 3 mm, an example 3 in which the curvature radius R is 4 mm, and an example 4 in which the curvature radius R is 5 mm, the fixing belt 21 has not been broken even when the number of passed papers is 200,000.

Moreover, the pressing member 26 side on the outer peripheral surface of the insertion part 38 of the end deformation restraint member 28 (the restraint body 35), that is, the lower end portion is separated from the fixing belt 21 by a gap S (see FIG. 3).

Figure 11:
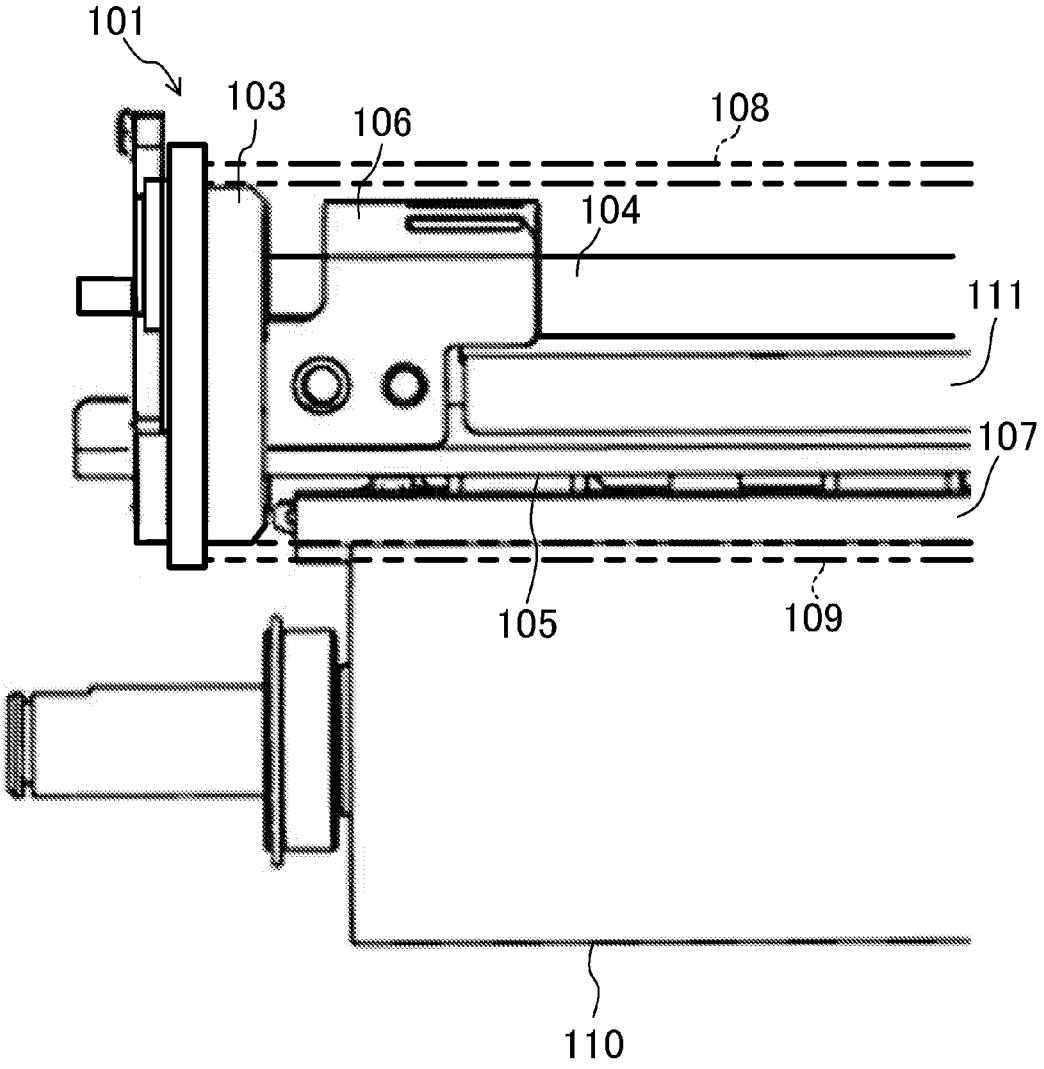
Fig.11 Prior Art
FIG. 11 is a diagram corresponding to FIG. 3, which illustrates a fixing device of a conventional example.
Figure 12:
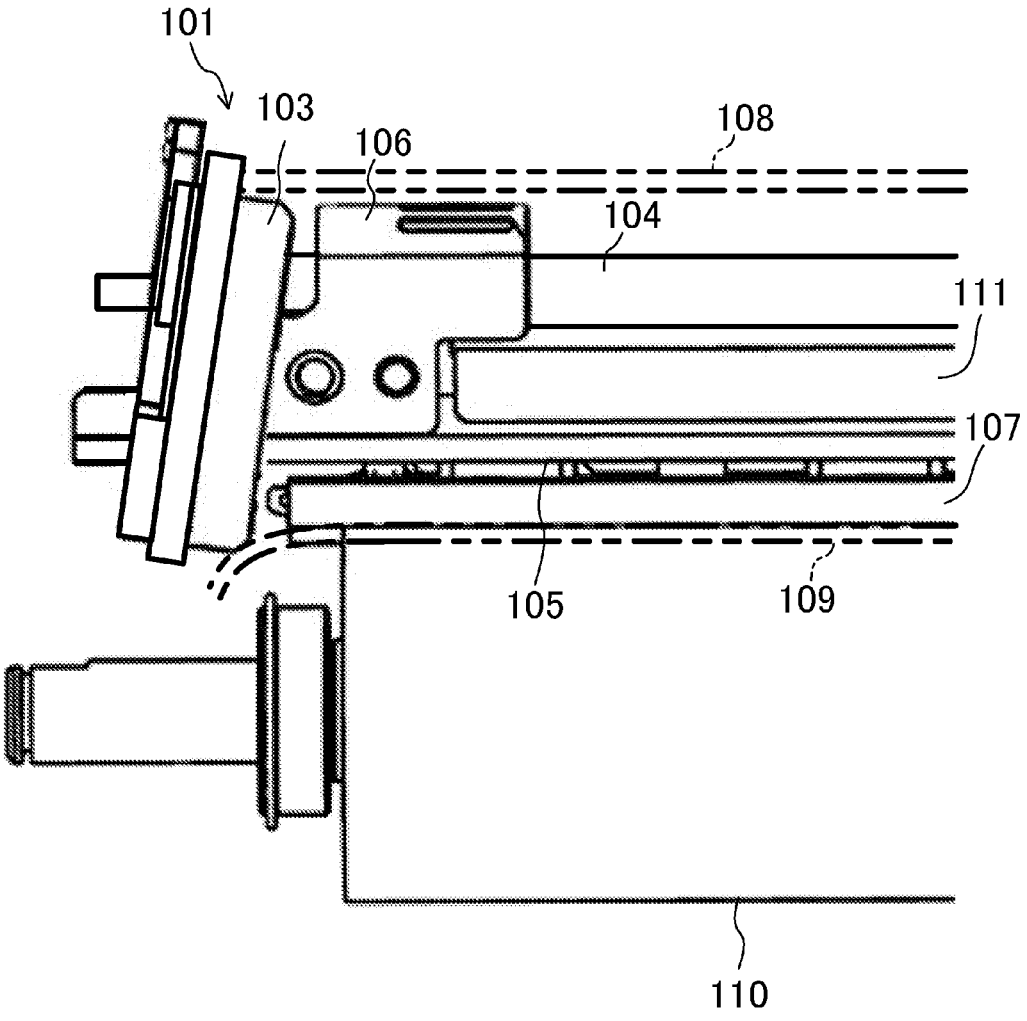
Fig.12 Prior Art
FIG. 12 is a diagram corresponding to FIG. 11, which illustrates a fixing device of a conventional example in which an end deformation restraint member has been inclined and belt end portions have been deformed.

In the conventional example, as illustrated in FIG. 11, since the opened end portions 103*a* (see FIG. 9 and FIG. 10) corresponding to both ends of the notch portion C of the lower end of the insertion part 103 of the end deformation restraint member 101 contact with the inner peripheral surface of a fixing belt 108 with no gap, the fixing belt 108 is deformed at the opened end portions 103*a* and stress is concentrated, resulting in the fatigue breakdown of the fixing belt 108. Moreover, for example, when the end deformation restraint member 101 is inclined as illustrated in FIG. 12 due to any situation such as distortion and the like of the side plate (not illustrated) of the housing which supports the end deformation restraint member 101, the opened end portions 103*a* of the lower end of the insertion part 103 press the inner peripheral surface of the fixing belt 108 downward, resulting in an increase in the deformation of the belt end portions. Particularly, since a pressure roller 110 presses a fixing nip 109 upward from below, the belt end portions are largely deformed by slight downward pressing force resulting in a large load. Therefore, when the fixing belt 108 rotates in this state, the fixing belt 108 may be broken.

However, in the present embodiment, since the outer peripheral surface of the lower end of the insertion part 38 of the end deformation restraint member 28 is separated from the fixing belt 21 by the gap S, even though the end deformation restraint member 28 is inclined as illustrated in FIG. 12 due to any situation such as distortion and the like of the side plate (not illustrated) of the housing 20 which supports the end deformation restraint member 28, it is possible to avoid the insertion part 38 from interfering with the fixing belt 21, thereby preventing the deformation of the belt end portions and thus preventing the breakdown of the fixing belt 21.

In FIG. 11 and FIG. 12, among reference numerals other than the reference numerals used in the aforementioned description, a reference numeral 104 indicates a heater, a reference numeral 105 indicates a support member, a reference numeral 106 indicates a cover member, a reference numeral 107 indicates a pressing member, and a reference numeral 111 indicates a reflecting plate. Roles of the respective elements are equal to names in the embodiment.

The ring 36 is formed in a ring shape. The ring 36 is engaged with an engagement groove 38*a* formed at the base part 37 side of the insertion part 38. A width of the ring 36 is equivalent to a groove width of the engagement groove 38*a*. Furthermore, the width of the ring 36 may also be smaller than the groove width of the engagement groove 38*a* or may also be movable in the front and rear direction. The ring 36 is arranged at the outside in the front and rear direction of both front and rear end portions of the fixing belt 21, thereby restraining the meandering (movement to the outside in the front and rear direction) of the fixing belt 21 and releasing the pressing of the fixing belt 21 in the front and rear direction. An upper portion of the ring 36 is arranged inside in the front and rear direction of the base part 37 of the restraint body 35, so that movement of the ring 36 to the outside in the front and rear direction is restrained.

In the fixing device 17 configured as above, when a toner image is fixed to a paper, the pressure roller 22 is rotated by the driving source (see an arrow A of FIG. 2). Accordingly, the fixing belt 21 is driven to rotate in a direction opposite to the rotation direction of the pressure roller 22 (see an arrow B of FIG. 2) and slides on the pressing member 26.

Furthermore, the heater 23 is operated. The radiant heat radiated from the heater 23 is directly irradiated to the inner peripheral surface of the fixing belt 21 so as to be absorbed (see an arrow H1 of FIG. 2) and is reflected by the upper surface of the reflecting plate 24 so as to be absorbed to the inner peripheral surface of the fixing belt 21 (see an arrow H2 of FIG. 2). In this way, the fixing belt 21 is heated.

In this state, when a paper passes through the fixing nip 30, a toner image is heated and molten, so that the toner image is fixed to the paper.

<<Modification>>

Figure 8:
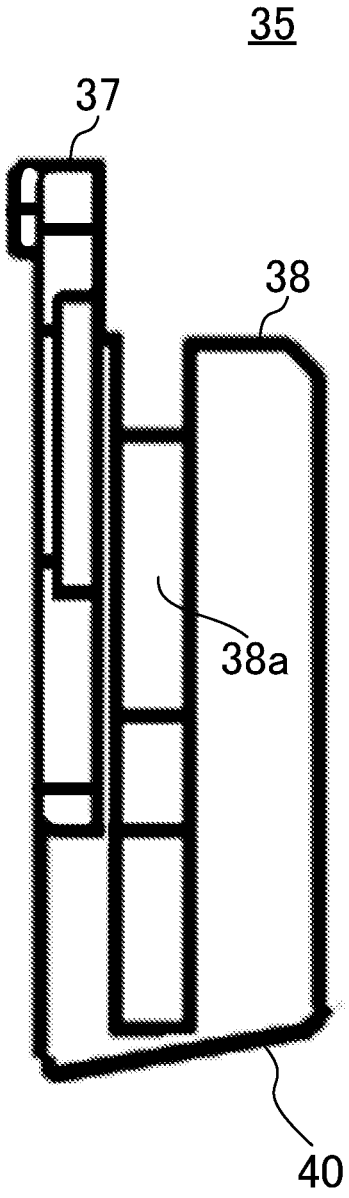
FIG. 8 is a diagram corresponding to FIG. 6, which illustrates a modification of an end deformation restraint member (a restraint body).

FIG. 8 is a diagram corresponding to FIG. 6, which illustrates a modification of the end deformation restraint member 28 (the restraint body 35).

In this modification, the pressing member 26 side on the outer peripheral surface of the insertion part 38 of the restraint body 35, that is, the lower end portion is formed to have an inclination surface 40 that increasingly approaches the belt rotation center as the inclination surface 40 goes toward the belt insertion side.

In this way, even though the end deformation restraint member 28 is inclined as illustrated in FIG. 12 due to any situation such as distortion and the like of the side plate (not illustrated) of the housing 20 which supports the end deformation restraint member 28, it is possible to avoid the lower end portion of the insertion part 38 from interfering with the fixing belt 21, thereby preventing the deformation of the belt end portions and thus preventing the breakdown of the fixing belt 21.

In addition, in the present embodiment, the case in which the technology of the present disclosure is applied to the printer 1 has been described. However, in other embodiments, it is also possible to apply the technology of the present disclosure to other image forming apparatuses such as a copy machine, a facsimile, and a multifunctional peripheral.

What is claimed is:

1. A fixing device comprising:

a heating unit;

an approximately cylindrical and flexible fixing belt heated by the heating unit;

a pressing member that presses an inner peripheral surface of the fixing belt;

a pressure roller that is brought into press contact with the pressing member while interposing the fixing belt between the pressure roller and the pressing member and is rotationally driven in a press-contact state, thereby rotating the fixing belt; and a pair of end deformation restraint members, wherein the fixing device allows a paper to pass through between the fixing belt and the pressure roller to fix a toner image to the paper, wherein the pair of end deformation restraint members are configured to have insertion parts which are inserted into both end portions of the fixing belt to restrain deformation of belt end portions by holding both end portions of the fixing belt, which slide on outer peripheral surfaces of the insertion parts, wherein each of the insertion parts has an arc portion formed in a C shape opened to a pressing member side when viewed from a belt rotation axis direction and a connecting plate portion that connects end parts on the pressing member side of the arc portion, and is continuous in a belt rotation direction with no gap, and wherein an entire surface of each of the connecting plate portions is formed to have an inclination surface that approaches a belt rotation center as the inclination surface goes toward a belt insertion side along the belt rotation axis direction.

2. The fixing device of claim 1, wherein a curvature radius of a paper passing entrance side and a paper passing discharge side on the outer peripheral surface of each of the insertion parts is equal to or more than 2 mm.

3. The fixing device of claim 1, wherein each of the connecting plate portions is separated from the fixing belt by a gap.

4. An image forming apparatus including the fixing device of claim 1.

5. The fixing device of claim 1, wherein an engagement groove is formed on a base end part in the outer peripheral surface of each of the insertion parts, a ring member that controls movement of the fixing belt in the belt rotation axis direction is engaged in each of the engagement grooves, and a width of the ring members is smaller than a groove width of the engagement grooves.

6. The fixing device of claim 1, wherein the pressing member is provided between each of the insertion parts of the pair of end deformation restraint members.

* * * * *